US009300043B2

(12) United States Patent
Houtman et al.

(10) Patent No.: US 9,300,043 B2
(45) Date of Patent: Mar. 29, 2016

(54) MULTIPLE FREQUENCY RANGE ANTENNA

(71) Applicants: Adam Houtman, Atlanta, GA (US); Robert Feltham, Ft. Lauderdale, FL (US); Ken Mullins, Delray Beach, FL (US)

(72) Inventors: Adam Houtman, Atlanta, GA (US); Robert Feltham, Ft. Lauderdale, FL (US); Ken Mullins, Delray Beach, FL (US)

( * ) Notice: Subject to any disclaimer, the term of this patent is extended or adjusted under 35 U.S.C. 154(b) by 129 days.

(21) Appl. No.: 14/185,787

(22) Filed: Feb. 20, 2014

(65) Prior Publication Data

US 2015/0236419 A1 Aug. 20, 2015

(51) Int. Cl.

| | |
|---|---|
| ***H01Q 9/04*** | (2006.01) |
| ***H01Q 5/40*** | (2015.01) |
| ***H01Q 1/38*** | (2006.01) |
| ***H01Q 5/25*** | (2015.01) |

(52) U.S. Cl.

CPC . *H01Q 5/40* (2015.01); *H01Q 1/38* (2013.01); *H01Q 5/25* (2015.01); *Y10T 29/49016* (2015.01)

(58) Field of Classification Search

CPC ..... H01Q 5/0027; H01Q 5/243; H01Q 5/371; H01Q 5/357; H01Q 5/378; H01Q 9/40; H01Q 3/00; H01Q 3/06; H01Q 3/34; H01Q 3/32; H01Q 3/005; H01Q 1/12; H01Q 1/24; H01Q 1/38; H01Q 1/52; H01Q 1/50; H01Q 1/246

USPC ..... 342/359, 368; 343/905, 702, 795, 770, 343/909, 729, 893, 700 MS

See application file for complete search history.

(56) References Cited

U.S. PATENT DOCUMENTS

| | | | | | |
|---|---|---|---|---|---|
| 5,986,609 | A * | 11/1999 | Spall | H01Q 1/243 | 343/700 MS |
| 6,529,170 | B1 * | 3/2003 | Nishizawa | H01Q 1/38 | 343/700 MS |
| 6,734,825 | B1 * | 5/2004 | Guo | H01Q 1/243 | 343/700 MS |
| 6,876,332 | B1 * | 4/2005 | Chung | H01Q 1/243 | 343/700 MS |
| 7,501,991 | B2 * | 3/2009 | Yeap | H01Q 1/38 | 343/700 MS |
| 7,541,984 | B2 * | 6/2009 | Peng | H01Q 1/243 | 343/700 MS |
| 7,589,694 | B2 * | 9/2009 | Martek | H01Q 1/362 | 343/795 |
| 8,766,870 | B2 * | 7/2014 | Jung | H01Q 1/243 | 343/700 MS |
| 2013/0127666 | A1 * | 5/2013 | Zhang | H01Q 1/246 | 342/359 |

* cited by examiner

*Primary Examiner* — Lam T Mai

(57) ABSTRACT

A multiple frequency range antenna may include a plurality of printed conductive arrays and a plurality of printed layers alternately placed together in a printed circuit board sandwich. A connection component may be attached to the printed an exposed section of the printed circuit board sandwich. A first end of an electrical cable may be attached to the connection component. The electrical cable may attach to the printed circuit board sandwich. In certain embodiments, an electrical connector component may be attached to a second end of the electrical cable. The multiple frequency range antenna may be used with an RF device.

10 Claims, 2 Drawing Sheets

MULTIPLE FREQUENCY RANGE ANTENNA

BACKGROUND OF THE INVENTION

The present invention relates to antennas and, more particularly, to a multiple frequency range antenna.

Currently, antennas are tuned to a specific frequency for specific tasks and devices. The range, size, mounting locations, resilience to damage, ability to conceal, ability to wear and ability to maintain effective orientation between portable antennas have been limiting factors. Currently, antennas are typical metal tubing or wire. These designs use either monopole or dipole antenna elements that are tuned to a specific frequency range. Typically large whip type antennas are normally used or come with the devices. These antennas are specifically tuned to a specific frequency range per device or application, and cannot be mounted elsewhere on the device per the user's requirement. These antennas have a more limited range, are easily damaged or broken and the polarity between antennas must be maintained to have the most effective communications, i.e. both antennas are vertical as opposed to one being vertical and the other one horizontal.

Transmission or reception by current whip antennas is orientation dependent, i.e. both antenna's vertical and parallel in respect to each other, if one is vertical and the other is off axis, i.e. perpendicular, there is increased RF signal loss. Maintaining vertical orientation reduces conceal-ability and is not always possible.

These devices do not work when moved from one device to another as they need to be tuned to match the different frequency ranges that the device uses. Limited range limits the effectiveness of the device transmitting and receiving a signal. If this type of antenna is damaged the device attached becomes completely ineffective.

As can be seen, there is a need for a multiple frequency range antenna that may be used in an array that may allow for an increase in effective range of the connected device over current antennas.

SUMMARY OF THE INVENTION

In one aspect of the present invention, a multiple frequency range antenna comprises: a plurality of printed conductive arrays and a plurality of printed layers alternately placed together in a printed circuit board sandwich; a connection component attached to the printed circuit board sandwich; and an electrical cable, wherein a first end of the electrical cable attaches to the connection component, wherein the electrical cable attaches to the printed circuit board sandwich.

In another aspect of the present invention, a method of increasing the distance range of an RF device comprises: providing a multiple frequency range antenna comprising: multiple frequency range antenna comprising: a plurality of printed conductive arrays and a plurality of printed layers alternately placed together in a printed circuit board sandwich, wherein the signal impedance of the plurality of printed layers are substantially consistent; a connection component attached to the printed circuit board sandwich; and an electrical cable, wherein a first end of the electrical cable attaches to the connection component, wherein the electrical cable attaches to the printed circuit board sandwich; attaching the electrical cable of the multiple frequency range antenna to the RF device with substantially the same impedance; and using the RF device as intended.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a multiple frequency range antenna that may include a plurality of printed conductive arrays and a plurality of printed layers alternately placed together in a printed circuit board sandwich. A connection component may be attached to the printed an exposed section of the printed circuit board sandwich. A first end of an electrical cable may be attached to the connection component. The electrical cable may attach to the printed circuit board sandwich. In certain embodiments, an electrical connector component may be attached to a second end of the electrical cable. The multiple frequency range antenna may be used with an RF device.

The present invention may include a plurality of conductive arrays embedded in a printed circuit board in a pattern that may be impossible to create in free standing metal or wire. The present invention may include dual planar parallel arrays of connected orthogonal elements that use near-field RF effect and trans-layer capacitive properties to create an efficient antenna for low-power usage for receiving and transmitting RF signals while being damage resistant. Used in an array format, the present invention may receive damage and still be able to function.

The present invention may be damage resistant, convenient and have a larger range than current available antennas. In certain embodiments, the multiple frequency range antenna may include an array of monopole antenna elements coupled in a dual offset array that may allow the multiple frequency range antenna 10 to receive and transmit on multiple frequency ranges. The cumulative effect of the individual antenna elements coupled together enable transceiver operations on multiple frequency ranges that current monopole or dipole antennas cannot operate on as they are tuned to a single frequency range. Current antennas are generally impedance matched to the transceiver with additional components for maximum efficiency. The present invention does not require additional components and does not require tuning.

Figure 1:
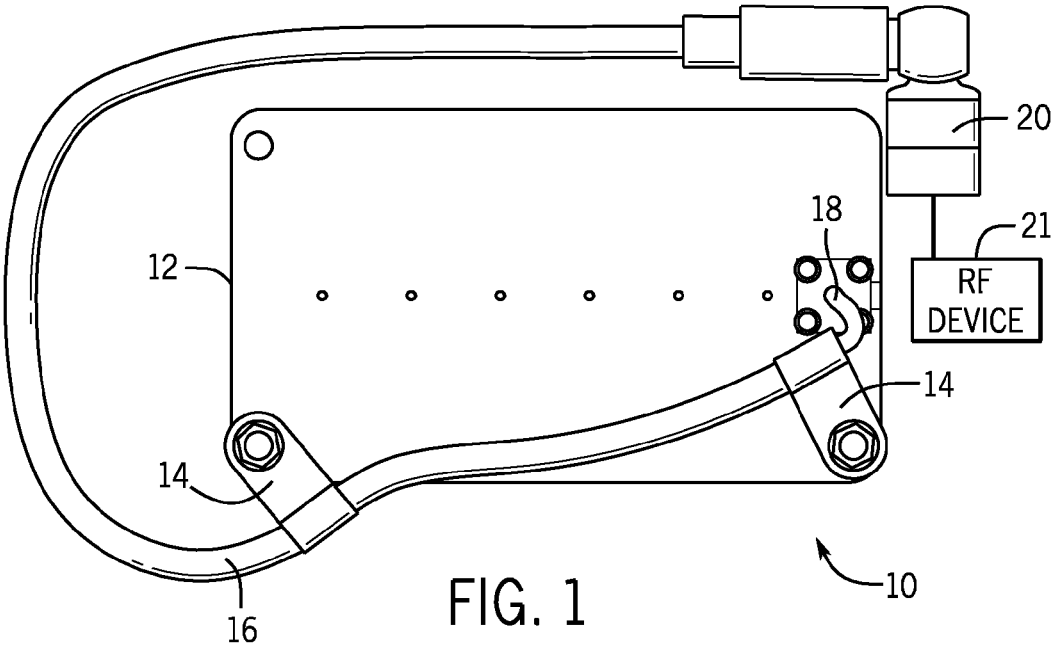
FIG. 1 is a top plan view of an exemplary embodiment of the present invention.
Figure 2:
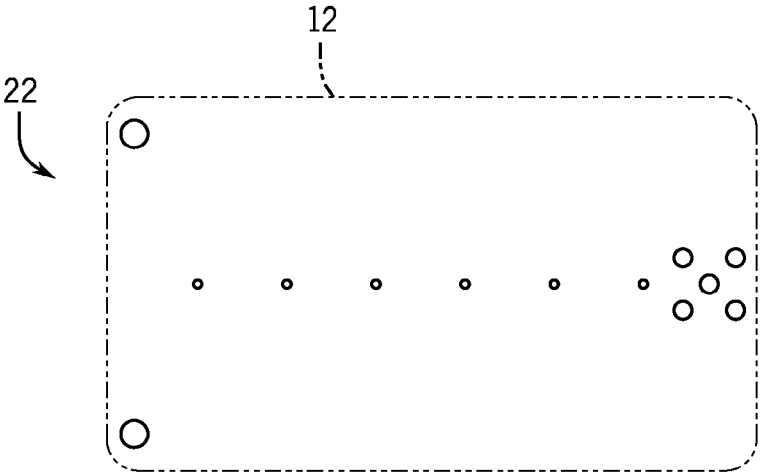
FIG. 2 is a top plan view of a printed layer of an exemplary embodiment of the present invention.
Figure 3:
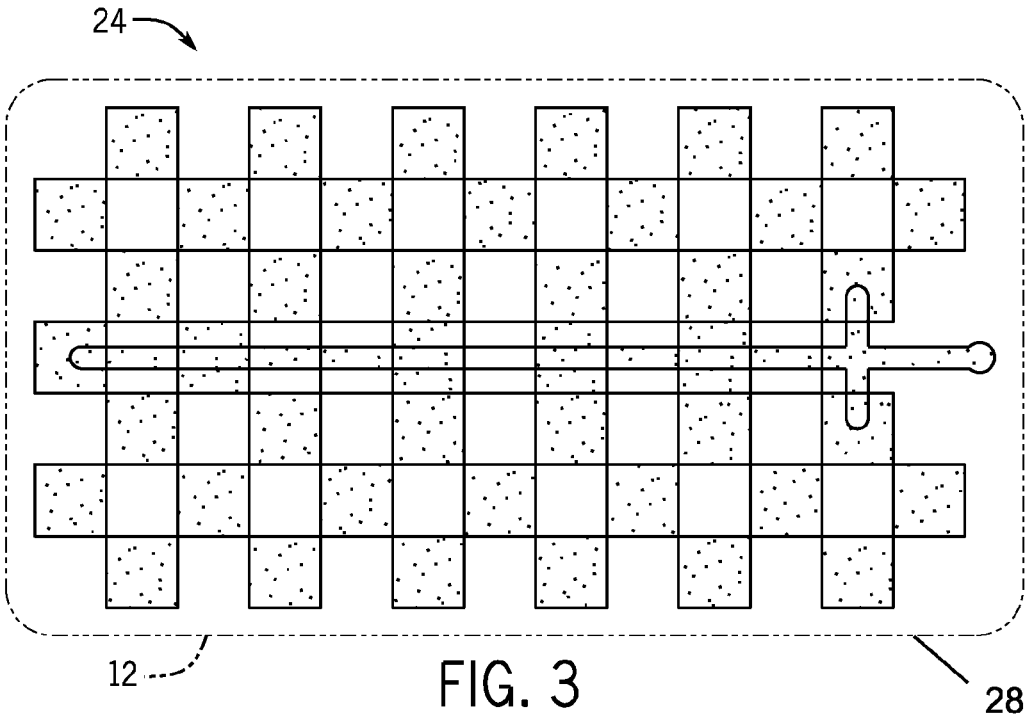
FIG. 3 is a top plan view of a printed conductive array of an exemplary embodiment of the present invention.
Figure 4:
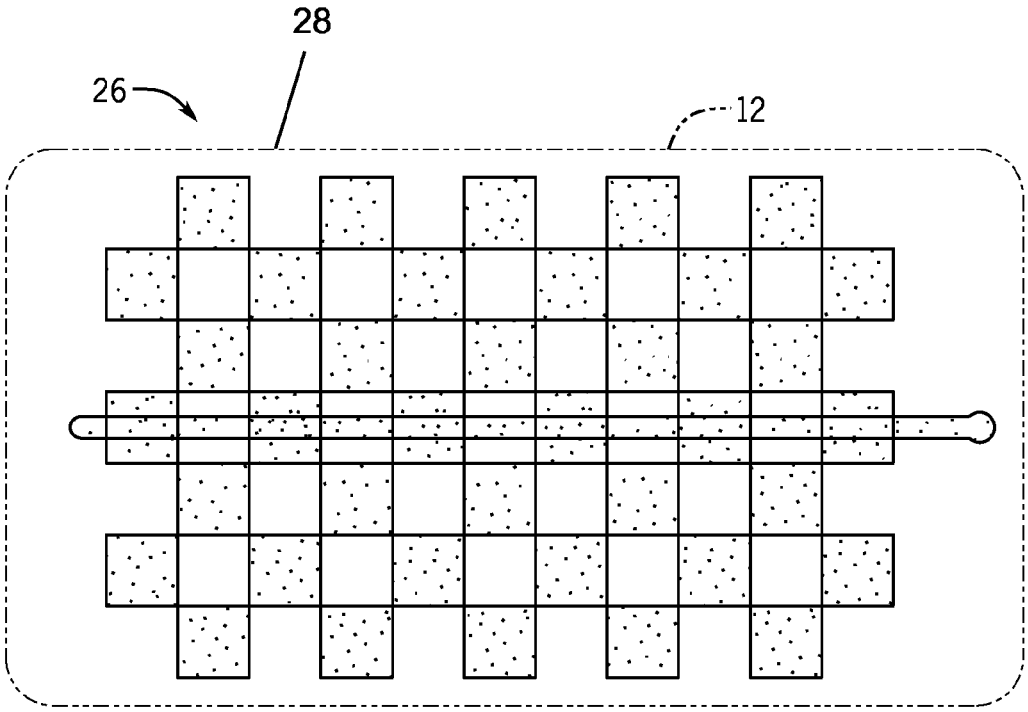
FIG. 4 is a top plan view of a second printed conductive array of an exemplary embodiment of the present invention.

As is illustrated in FIGS. 1 through 4, the multiple frequency range antenna 10 may include a plurality of printed conductive arrays 28. The multiple frequency range antenna 10 may also include a plurality of printed layers 22. The combination of the plurality of printed conductive arrays 28 and the plurality of printed layers 22 may be alternately placed together in a printed circuit board sandwich 12. The printed circuit board sandwich 12 may have an exposed section along a top layer that allows access to connect with each layer in the printed circuit board sandwich 12. In certain embodiments, a first printed conductive array 24 may be used. A second printed conductive array 26 may be used and the like.

Connected to the printed circuit board sandwich may be a connection component 18. The connection component 18 may connect to an exposed section along the top layer of the printed circuit board sandwich 12 allowing for physical contact and access to the various layers of the printed circuit board sandwich 12. Connected to the connection component 18 may be an electrical cable 16. A first end of the electrical cable 16 may be attached to the connection component 18. The electrical cable 16 may be attached to the printed circuit board sandwich 12. In certain embodiments, the electrical cable 16 may be attached to the printed circuit board sandwich 12 by a plurality of electrical cable clamps 14. A second end of the electrical cable 16 may attach to an electrical connector component 20.

In certain embodiments, the geometry of the trace width and separation may match the characteristic impedance of the radio transmitters to eliminate the need for tuning the antenna with external inductor coils and/or capacitors by taking into account the Dielectric Constant and relative permittivity of the material used to construct the multiple frequency range antenna 10. The matched signal impedance of the internal layers that holds the antenna array pattern may be consistent. In certain embodiments, the impedance may be 50 ohms, 75 ohms, and the like. The multiple frequency range antenna 10 may be constructed to match any desired impedance.

In certain embodiments, the present invention may convert radio frequency (RF) energy into electromagnetic current on the elements of the printed circuit board sandwich 12 of the present invention 10 which may be fed into an RF device 21, such as an RF receiver, across a wider range of frequencies than traditional antennas. The present invention may also convert modulated electrical currents into electro-magnetic emissions that may be transmitted by the elements of the printed circuit board sandwich 12. The construction of the multiple frequency range antenna 10 may allow for matched impedance to the attached RF device 21. Almost all of the RF energy may be transmitted out the multiple frequency range antenna 10 with minimal/no signal reflections back to the RF device 21. When operating in a receiving mode, the maximum amount of the RF signal may be passed into the RF device 21, such as an RF receiver or the like. In certain embodiments, the individual elements of the plurality of printed conductive arrays 28 may be offset on the plurality of printed layers 22 due to their size and arrangement as they are inter-connected together and the central impedance matched signal may trace the RF signal of a wide frequency range may be more efficiently coupled to the attached RF device 21 via the electrical cable 16, such as a co-axial cable, with the electrical connector component 20, such as a co-axial RF connector. In certain embodiments the multiple frequency range antenna 10 may be attached to the RF device 21 by directly connecting to a co-axial RF connector with the proper impedance.

A person may route a set of printed circuit design files that are designed and calculated to create a trace topography that creates the desired characteristic impedance of the RF devices that the multiple frequency range antenna 10 may be attached to. The person may be able to design the trace topography to combine RF signals across a wide range of RF frequencies to maximize efficiency for both transmission and reception without damaging the RF device 21 while transmitting due to poor impedance matching.

In certain embodiments, the plurality of printed layers 22 may be made from a thickness of approximately 1 oz of copper or the like. In certain embodiments, the printed circuit board sandwich 12 may include a top printed layer 22 of approximately 1 oz of copper, a printed conductive array 28 having an approximate thickness range of 7-9 mils, a first inner printed layer 22 of approximately 1 oz of copper, a printed conductive array 28 having an approximate thickness range of 36-42 mils, a second inner printed layer 22 of approximately 1 oz of copper, a printed conductive array 28 having an approximate thickness range of 7-9 mils and a bottom printed layer 22 of approximately 1 oz of copper.

A method of using the present invention may include the following. An individual may connect the multiple frequency range antenna 10 to an impedance matched RF device 21 such as a 50 Ohm impedance matched multiple frequency range antenna 10 to a 50 Ohm RF device 21, a 75 Ohm multiple frequency range antenna 10 to a 75 Ohm RF device 21, and the like. The individual may use the RF device 21 as originally intended. Typically the individual who wants better reception, such as increased operational RF range, may use the present invention instead of the individual's original antenna. The present invention may have a long RF range, such as increased distance between devices regardless of the multiple frequency range antenna 10 orientation. An example of this increased distance may be illustrated with one person lying down and the other person standing while both may be using the present invention. The orientation of the plurality of the printed conductive arrays 28 may allow for effective communication in multiple locations, and distances between devices.

It should be understood, of course, that the foregoing relates to exemplary embodiments of the invention and that modifications may be made without departing from the spirit and scope of the invention as set forth in the following claims.

What is claimed is:

1. A multiple frequency range antenna comprising:

a plurality of printed conductive arrays and a plurality of printed layers alternately placed together in a printed circuit board sandwich;

a connection component attached to the printed circuit board sandwich; and an electrical cable, wherein a first end of the electrical cable attaches to the connection component, wherein the electrical cable attaches to the printed circuit board sandwich.

2. The multiple frequency range antenna of claim 1, wherein a signal impedance of the plurality of printed layers is substantially consistent.

3. The multiple frequency range antenna of claim 1, wherein the electrical cable is attached to the printed circuit board sandwich by a plurality of electrical cable clamps.

4. The multiple frequency range antenna of claim 1, further comprising an electrical connector component attached to a second end of the electrical cable.

5. The multiple frequency range antenna of claim 1, wherein the plurality of printed conductive arrays and the plurality of printed layers of the printed circuit board sandwich comprise a top printed layer, a first printed conductive array, a first inner printed layer, a second printed conductive array, a second inner printed layer, a third printed conductive array and a bottom printed layer.

6. The multiple frequency range antenna of claim 5, wherein the plurality of printed layers are made from a thickness of approximately 1 oz of copper material.

7. The multiple frequency range antenna of claim 6, wherein the first printed conductive array and the third printed conductive array are made from dielectric material of an approximate thickness range of 7-9 mils.

8. The multiple frequency range antenna of claim 7, wherein the second conductive array is made from dielectric material of an approximate thickness range of 36-42 mils.

9. A method of increasing a distance range of an RF device comprising:

providing a multiple frequency range antenna comprising:

a plurality of printed conductive arrays and a plurality of printed layers alternately placed together in a printed circuit board sandwich, wherein a signal impedance of the plurality of printed layers is substantially consistent; a connection component attached to the printed circuit board sandwich; and an electrical cable, wherein a first end of the electrical cable attaches to the connection component, wherein the electrical cable attaches to the printed circuit board sandwich;

attaching the electrical cable of the multiple frequency range antenna to the RF device with substantially the same impedance; and using the RF device as intended.

10. The method of claim 9, further comprising attaching an electrical connector component to a second end of the electrical cable of the multiple frequency range antenna, wherein an other end of the electrical connector component attaches to the RF device.

* * * * *